US010267502B2

(12) United States Patent
Abrina et al.

(10) Patent No.: US 10,267,502 B2
(45) Date of Patent: Apr. 23, 2019

(54) ADJUSTABLE-BEAM LIGHTING FIXTURE

(71) Applicant: Electrix, LLC, New Haven, CT (US)

(72) Inventors: Armando A. Abrina, New Haven, CT (US); Mark E. Lahner, Guilford, CT (US); Floyd H. Rose, Fuquay Varina, NC (US)

(73) Assignee: Electrix, LLC, New Haven, CT (US)

( * ) Notice: Subject to any disclaimer, the term of this patent is extended or adjusted under 35 U.S.C. 154(b) by 135 days.

(21) Appl. No.: 15/275,593

(22) Filed: Sep. 26, 2016

(65) Prior Publication Data

US 2017/0089549 A1 Mar. 30, 2017

Related U.S. Application Data

(60) Provisional application No. 62/234,949, filed on Sep. 30, 2015.

(51) Int. Cl.

| | |
|---|---|
| ***F21V 17/02*** | (2006.01) |
| ***F21S 8/00*** | (2006.01) |
| ***F21V 23/00*** | (2015.01) |
| ***F21V 23/06*** | (2006.01) |
| ***F21V 3/02*** | (2006.01) |
| ***F21V 15/015*** | (2006.01) |
| ***F21V 14/02*** | (2006.01) |
| ***F21V 19/02*** | (2006.01) |
| ***F21V 21/02*** | (2006.01) |
| *F21Y 103/10* | (2016.01) |
| *F21Y 115/10* | (2016.01) |
| *F21V 21/30* | (2006.01) |

(52) U.S. Cl.

CPC ..... *F21V 23/007* (2013.01); *F21S 8/033* (2013.01); *F21V 3/02* (2013.01); *F21V 14/02* (2013.01); *F21V 15/015* (2013.01); *F21V 19/02* (2013.01); *F21V 21/02* (2013.01); *F21V 23/06* (2013.01); *F21V 21/30* (2013.01); *F21Y 2103/10* (2016.08); *F21Y 2115/10* (2016.08)

(58) Field of Classification Search

CPC ..... F21V 17/02; F21V 17/18; F21V 19/02; F21S 8/024

See application file for complete search history.

(56) References Cited

U.S. PATENT DOCUMENTS

| | | | | |
|---|---|---|---|---|
| 5,404,283 | A * | 4/1995 | Yantz | F21V 11/18 362/267 |
| 2006/0158887 | A1* | 7/2006 | Holder | F21V 14/02 362/341 |
| 2009/0109687 | A1* | 4/2009 | Householder | F21L 4/027 362/309 |
| 2011/0317286 | A1* | 12/2011 | Drost | G03B 3/02 359/798 |

* cited by examiner

*Primary Examiner* — Karabi Guharay

(74) *Attorney, Agent, or Firm* — Bachman & LaPointe, P.C.

(57) ABSTRACT

A light fixture comprises: a base; a light carrier pivotally mounted to the base; a light source carried by the light carrier; and an optic carried by the light carrier; wherein: the light source is mounted for adjustable spacing between the light source and the optic.

22 Claims, 13 Drawing Sheets

ADJUSTABLE-BEAM LIGHTING FIXTURE

CROSS-REFERENCE TO RELATED APPLICATION

Benefit is claimed of U.S. Patent Application No. 62/234,949, filed Sep. 30, 2015, and entitled "Adjustable-Beam Lighting Fixture", the disclosure of which is incorporated by reference herein in its entirety as if set forth at length.

BACKGROUND

The disclosure relates to lighting fixtures. More particularly, the disclosure relates to linear lighting fixtures such as wall wash lighting fixtures.

In architectural lighting, it is often desired to wash a wall with light. Light fixtures are located in the ceiling near the wall and positioned to direct light downward along the wall (grazing the wall). Other indirect lighting applications for linear fixtures include cove lighting and direct lighting applications for linear fixtures include downlighting.

Linear light emitting diode (LED) lighting fixtures have been recently proposed. These typically include a single linear array of LEDs mounted on each of one or more linearly-arrayed circuit boards.

SUMMARY

One aspect of the disclosure involves a light fixture comprising: a base; a light carrier pivotally mounted to the base; a light source carried by the light carrier; and an optic carried by the light carrier. The light source is mounted for adjustable spacing between the light source and the optic.

In one or more embodiments of any of the foregoing embodiments, the light source comprises light emitting diodes.

In one or more embodiments of any of the foregoing embodiments, one or more springs bias the light source in a first direction relative to the optic and an adjuster shifts the light source against the bias to provide the adjustable spacing.

In one or more embodiments of any of the foregoing embodiments, the one or more springs comprise one or more coil springs along each side of the optic.

In one or more embodiments of any of the foregoing embodiments, the light source comprises a circuit board carrying the light emitting diodes and a board carrier carrying the circuit board.

In one or more embodiments of any of the foregoing embodiments, the adjuster comprises a cam mounted for rotation about a cam axis and engageable with the board carrier via rotation about the cam axis to shift the light source against the bias to provide the adjustable spacing.

In one or more embodiments of any of the foregoing embodiments, the cam has a detented engagement with the board carrier.

In one or more embodiments of any of the foregoing embodiments, the cam has a plurality of discrete surface portions providing the adjustable spacing as a discretely adjustable spacing.

In one or more embodiments of any of the foregoing embodiments, the cam comprises a metallic extrusion having a plurality of lobes.

In one or more embodiments of any of the foregoing embodiments, a screw is threaded into the cam and passes through an endplate of a housing of the light carrier.

In one or more embodiments of any of the foregoing embodiments, the screw is drivable to rotate the cam about the cam axis.

In one or more embodiments of any of the foregoing embodiments, the light source comprises a plurality of said circuit boards carried by a single said board carrier and, on each said circuit board, the light emitting diodes are in a linear array.

In one or more embodiments of any of the foregoing embodiments, the light carrier is mounted to the base for rotation about a light carrier axis.

In one or more embodiments of any of the foregoing embodiments, the light carrier is mounted to the base for the rotation about the light carrier axis by a pair of rings protruding from a main portion of the base and capturing a housing of the light carrier.

In one or more embodiments of any of the foregoing embodiments, a detent mechanism detents the rotation about the light carrier axis and comprises extruded scallop features in a housing of the light carrier interacting with a detenting member.

In one or more embodiments of any of the foregoing embodiments, the detenting member is self-sprung and formed as a molding or an extrusion.

In one or more embodiments of any of the foregoing embodiments, a driver is carried within the base.

In one or more embodiments of any of the foregoing embodiments, the optic comprises a molded or extruded member having a central portion for passing light from the light source and a pair of lateral mounting flanges.

In one or more embodiments of any of the foregoing embodiments, a method for using the system comprises rotating a cam mounted about a cam axis shift the light source against a bias to adjust the adjustable spacing.

In one or more embodiments of any of the foregoing embodiments, the rotating includes a detented cooperation of the cam and a carrier of the light source.

In one or more embodiments of any of the foregoing embodiments, the method further comprises a detented rotating of the light carrier relative to the base.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
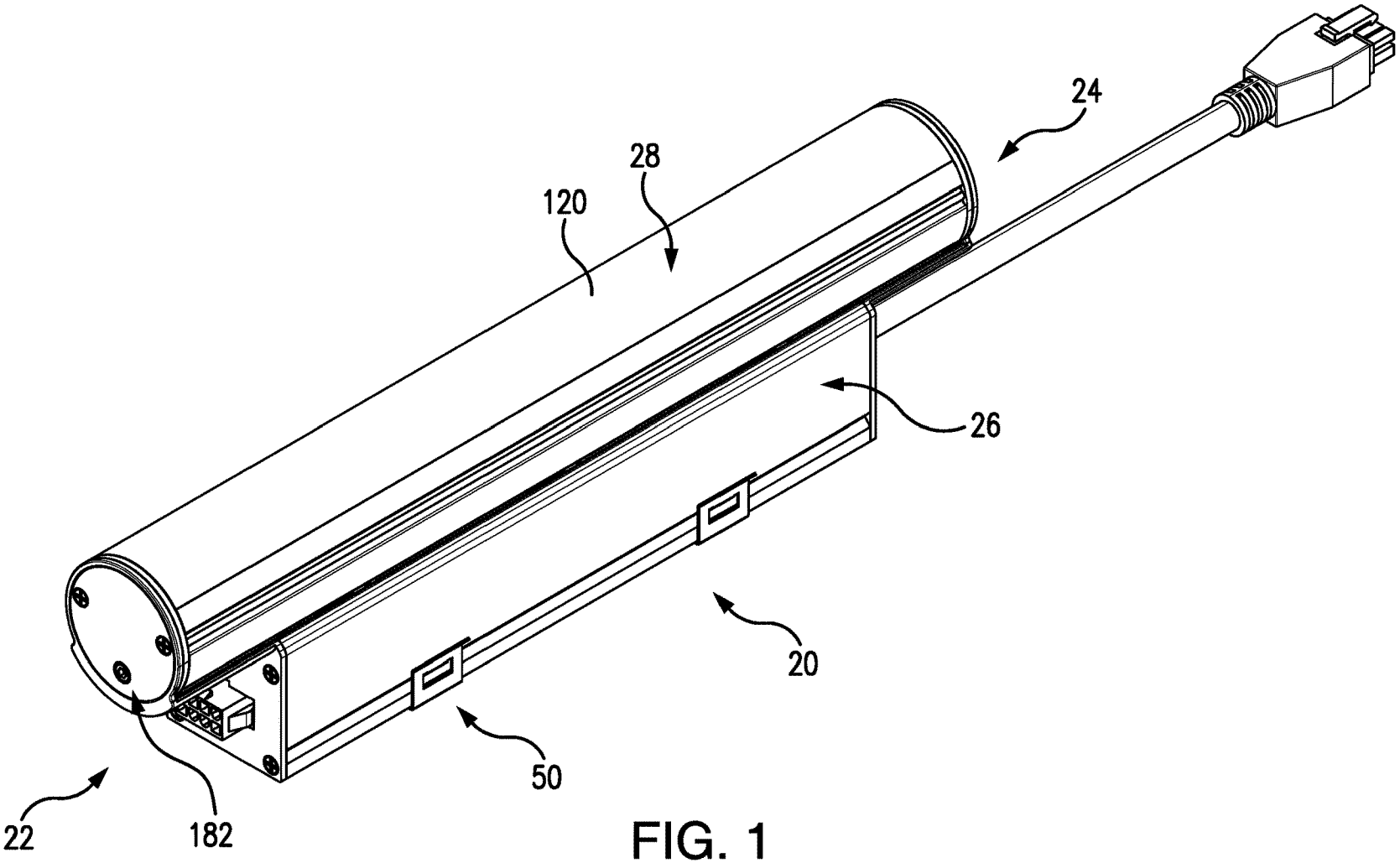
FIG. 1 is a view of a light fixture.

FIG. 1 shows a light fixture 20 extending from a first end 22 to a second end 24 and having a mounting base 26 and a light carrier assembly (light carrier) 28 pivotally mounted to the mounting base for rotation about a pivot axis.

Figure 2:
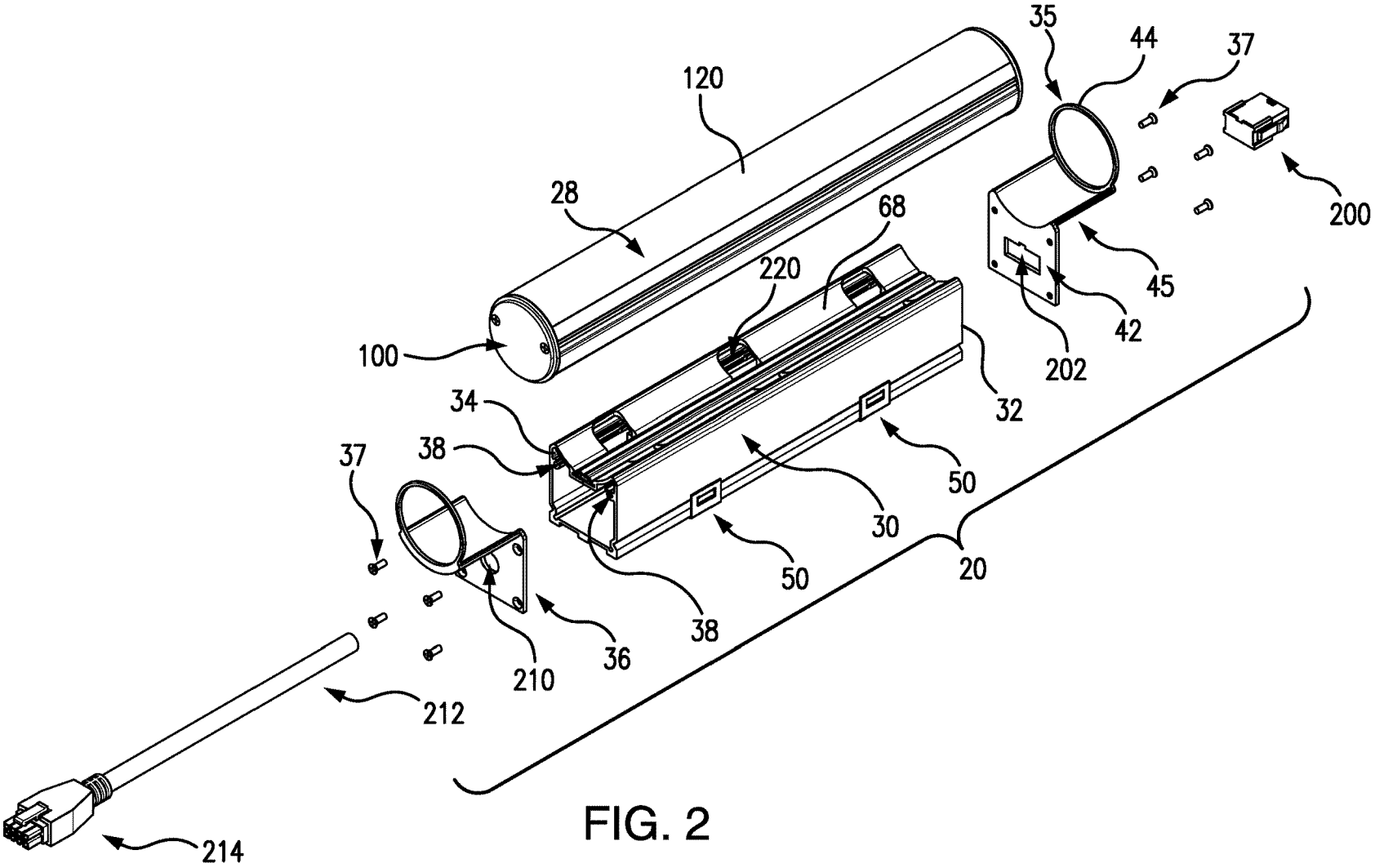
FIG. 2 is a partially exploded view of the fixture.

FIG. 2 shows the fixture 20 partially exploded. The base comprises a main body 30 extending between a first end 32 and a second end 34. At the ends, a pair of end members 35 and 36 are mounted (e.g., via screws 37 into ends of channels 38). The exemplary base main body 30 is formed as a hollow extrusion (e.g., of aluminum alloy) of generally box-like section to define an interior space for carrying a driver (e.g., transformer) or other electronics 40 (FIG. 6). Each exemplary end member 35, 36 (e.g., stamped or cast aluminum alloy) may comprise an endplate portion 42 (e.g., having holes passing shafts of the screws 37) for enclosing the associated end of the main body and a pivot ring 44 (offset by a collar segment 45) for holding the light carrier for rotation about the pivot axis 500 (FIG. 5).

Figure 5:
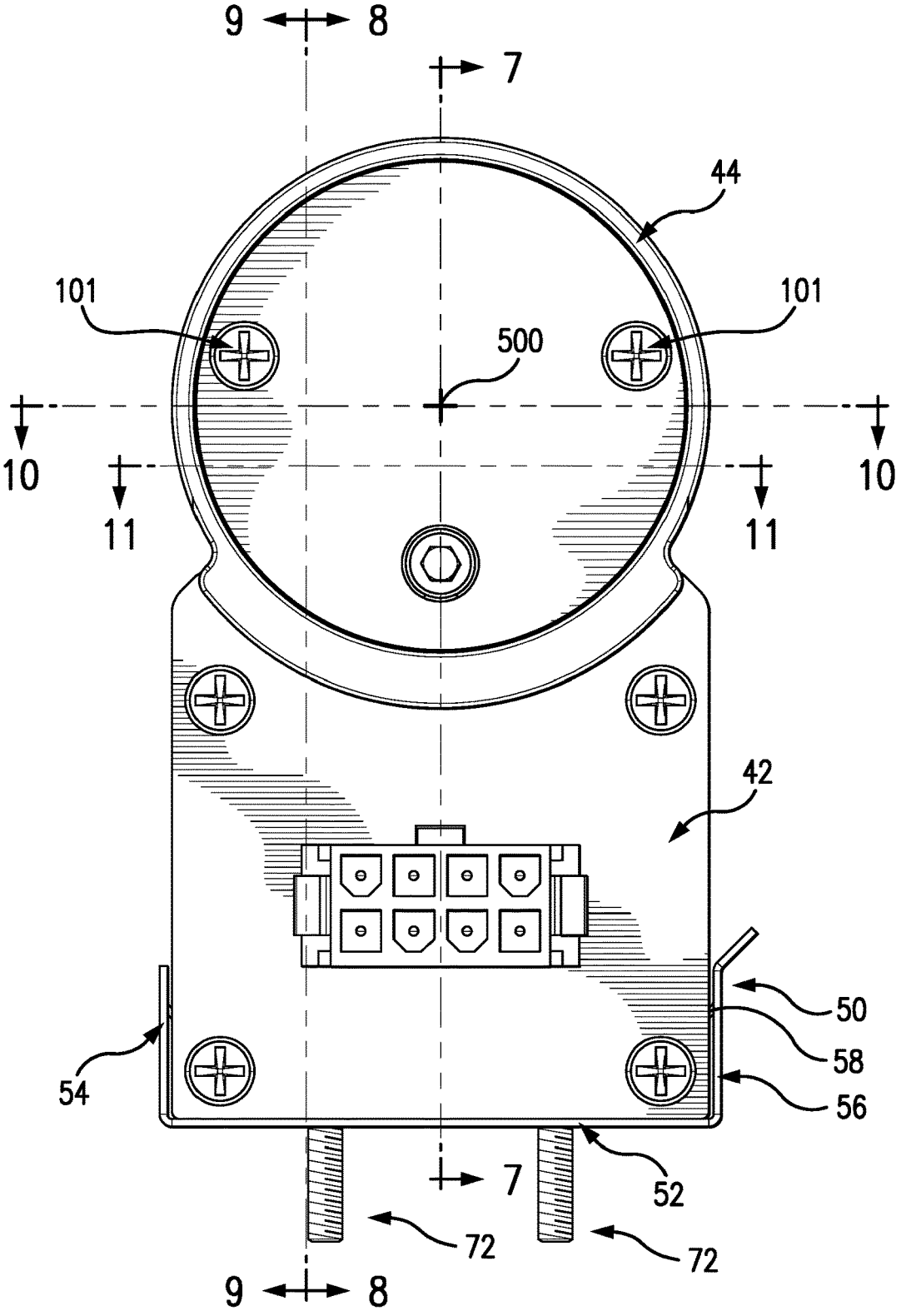
FIG. 5 is an end view of the fixture.
Figure 6:
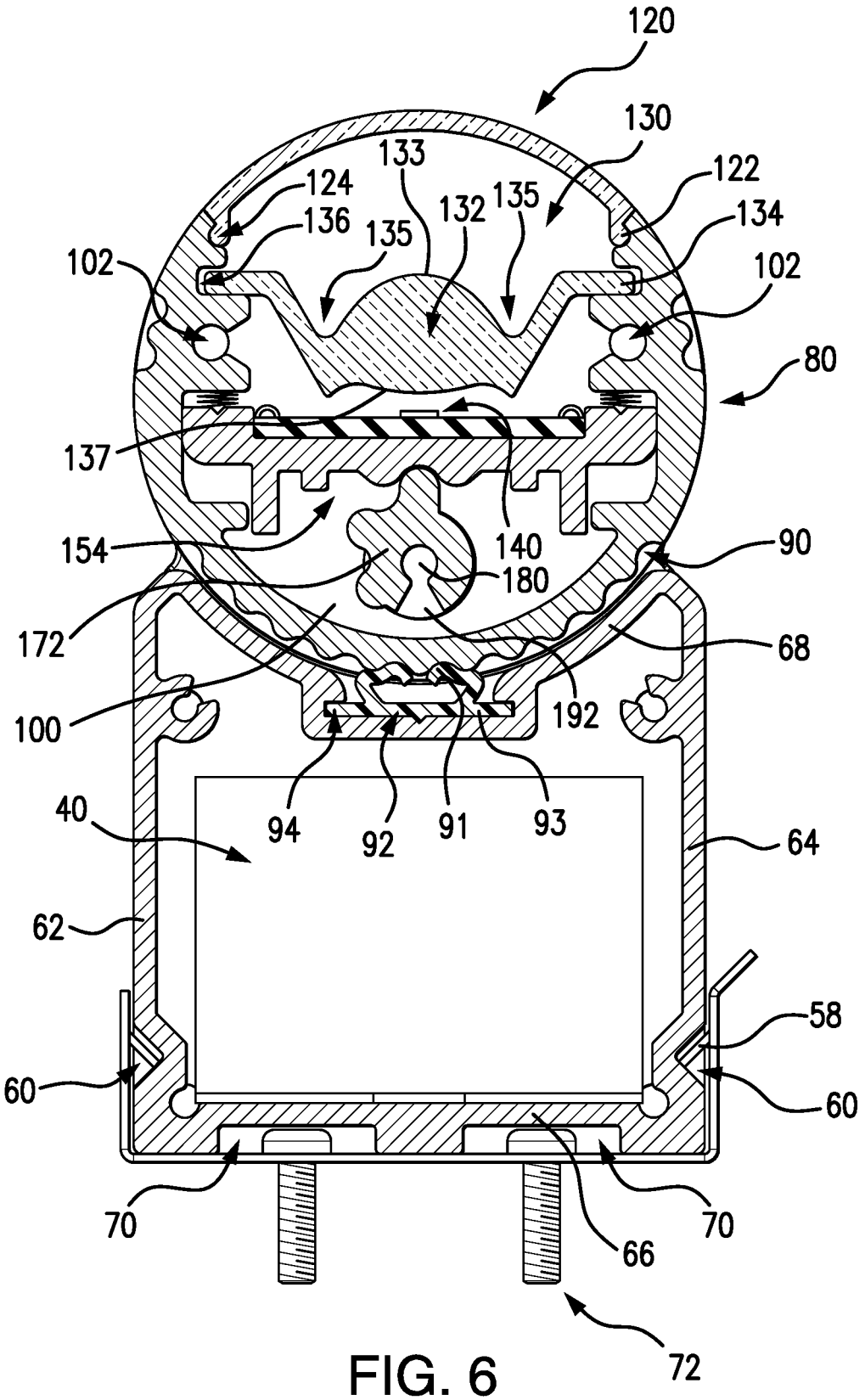
FIG. 6 is a transverse sectional view of the fixture taken along line 6-6 of FIG. 4A.
Figure 7:
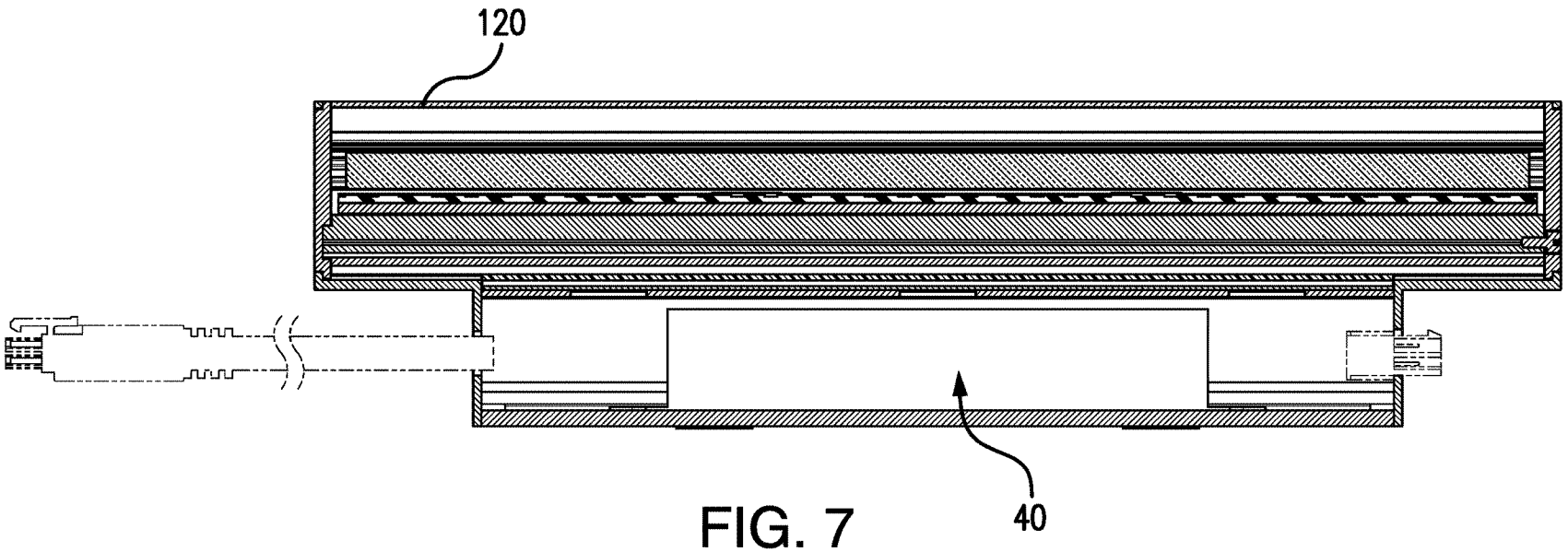
FIG. 7 is a central longitudinal sectional view of a light carrier of the fixture taken along line 7-7 of FIG. 5.
Figure 8:
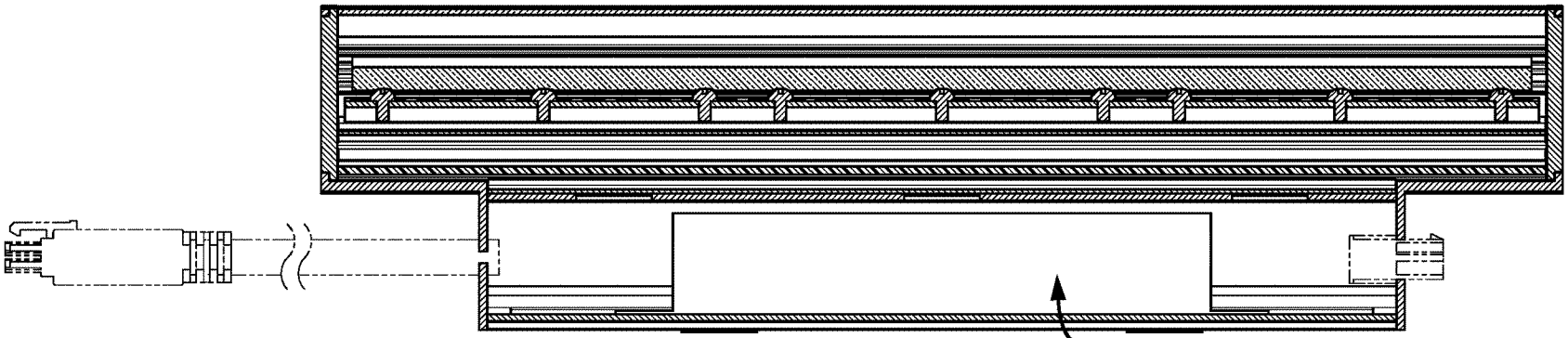
FIG. 8 is a longitudinal sectional view of the light carrier taken along line 8-8 of FIG. 5.
Figure 9:
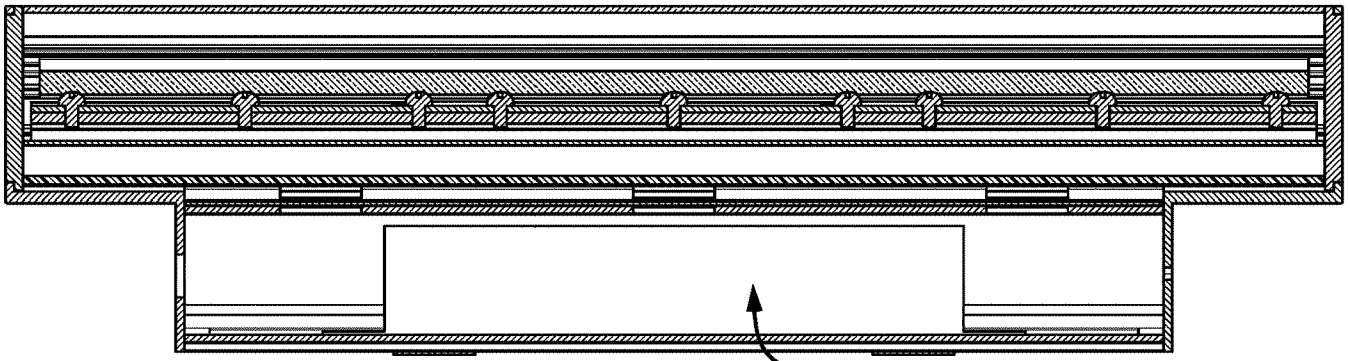
FIG. 9 is a longitudinal section view of the light carrier taken along line 9-9 of FIG. 5.
Figure 10:
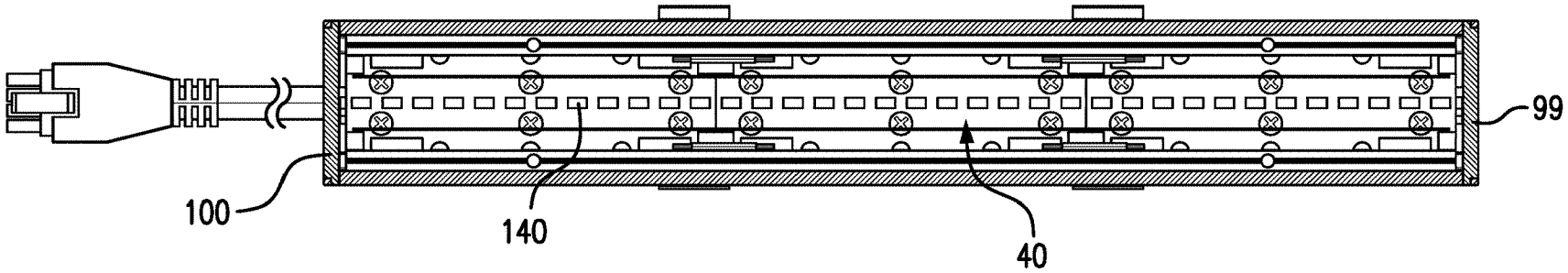
FIG. 10 is a longitudinal sectional view of the light carrier taken along line 10-10 of FIG. 5.
Figure 11:
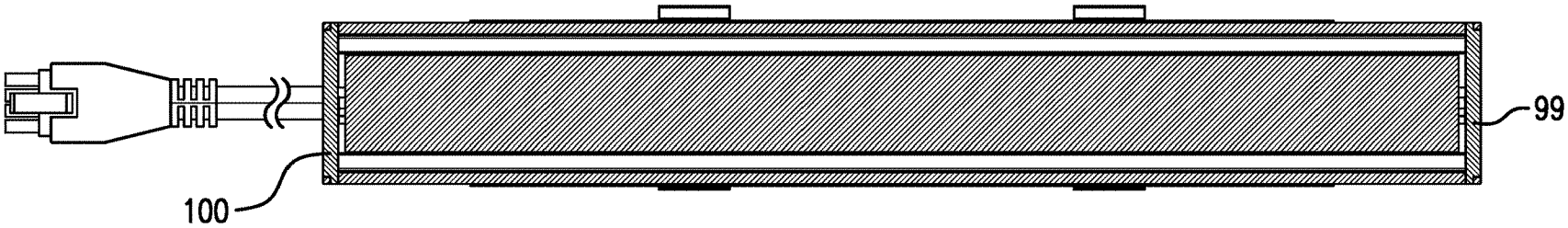
FIG. 11 is a longitudinal sectional view of the light carrier taken along line 11-11 of FIG. 5.

FIG. 5 further shows mounting clips 50 for mounting the fixture to a surface of a building (e.g., a wall surface). The exemplary mounting clips are stamped from sheet metal (e.g., steel or aluminum) and include a base portion 52 for lying flat against the mounting surface and a pair of side walls 54, 56 cooperating with the base portion 52 to form a channel receiving an adjacent portion of the base main body 30. Each of the sidewalls may have features for interlocking with the base main body (e.g., bent tabs 58) engaging complementary recesses 60 (FIG. 6) in sidewalls 62, 64 of the base main body. The base main body further comprises a base wall 66 and an outer wall 68. FIG. 6 shows the base wall underside having a pair of recesses 70 each accommodating the head of a respective fastener (e.g., screw 72) passing through the clip 50 to secure the clip to the mounting surface.

Figure 3:
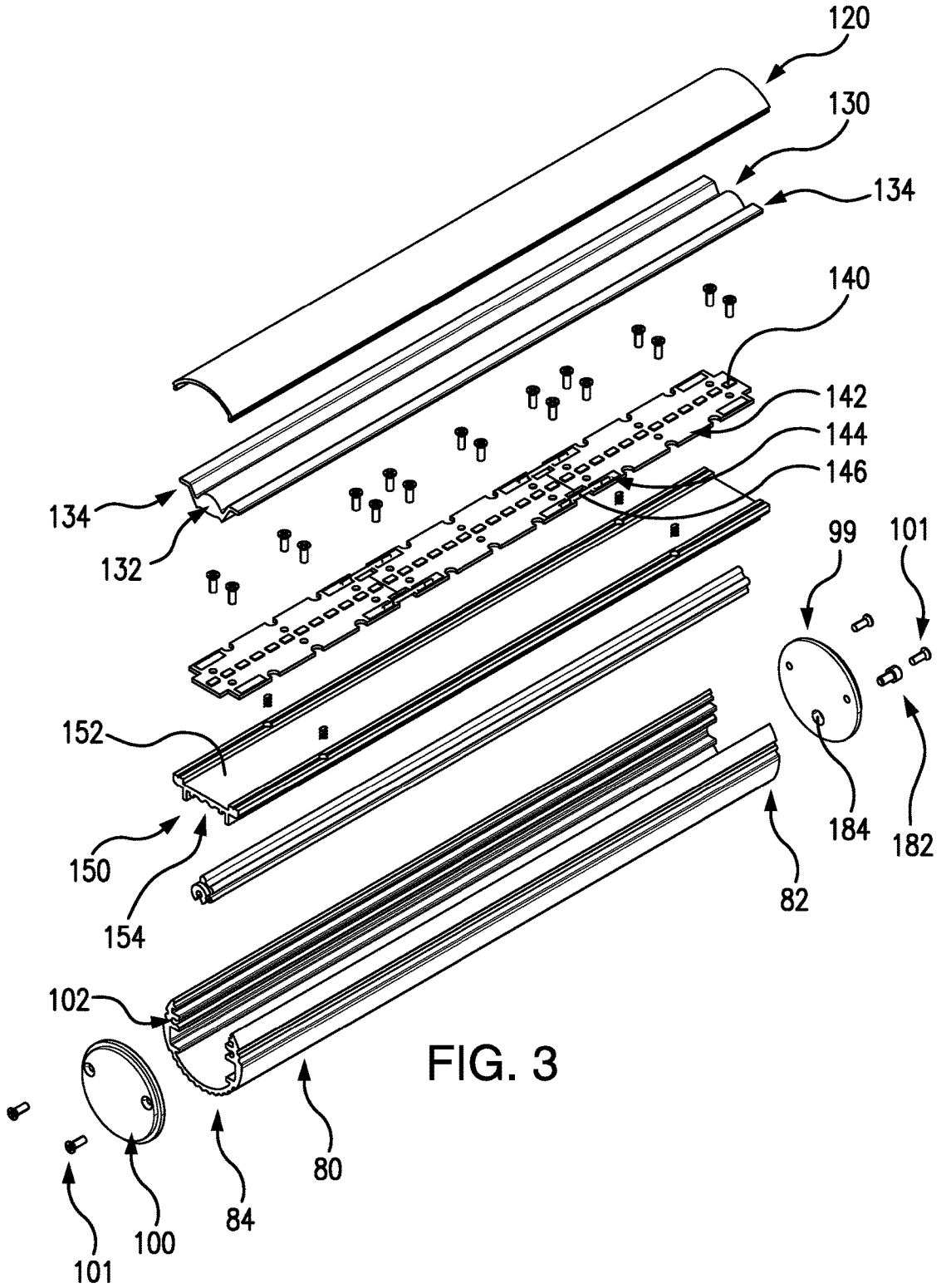
FIG. 3 is a partially exploded view of a light holder of the fixture.

FIGS. 3 and 6 show the carrier assembly as comprising a carrier main body 80. In the exemplary body, this is formed as a metallic extrusion (e.g., aluminum alloy). The carrier main body extends between a first end 82 and a second end 84. The carrier main body has a generally arcuate exterior profile (in the illustrated example, as an exterior profile corresponding to a sector of a circle with a series of scalloped concave reliefs 90 (FIG. 6)). The reliefs 90 may cooperate with members carried by the base to define a detent mechanism to detent the angular orientation of the carrier assembly about the axis 500. In the FIG. 6 embodiment, the member(s) are the arms 91 of one or more molded or extruded non-metallic members 92. In the exemplary embodiment, there is a single extruded member 92 formed of acrylic with a plate-like base 93 installed in a compartment 94 in the main body outer wall 68. The base 93 may be slid into the compartment in initial assembly. The arms 91 are self-sprung to detentedly engage two of the reliefs 90 and allow detented rotation of the carrier about the axis 500. In an alternative variation shown in the aforementioned US 62/234,949 application, the members are ends of spring-loaded detents carried by the base to define the detent mechanism.

Figure 4:
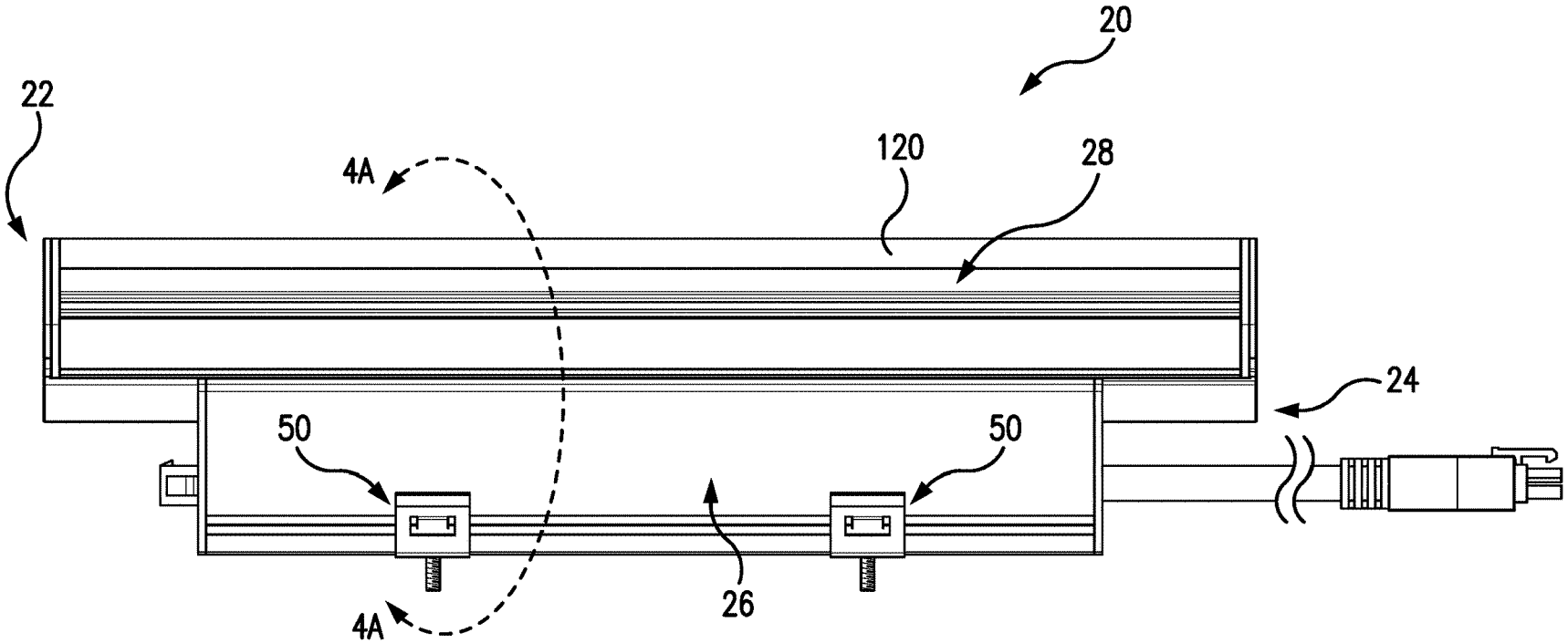
FIG. 4 is a side view of the fixture.
Figure 4A:
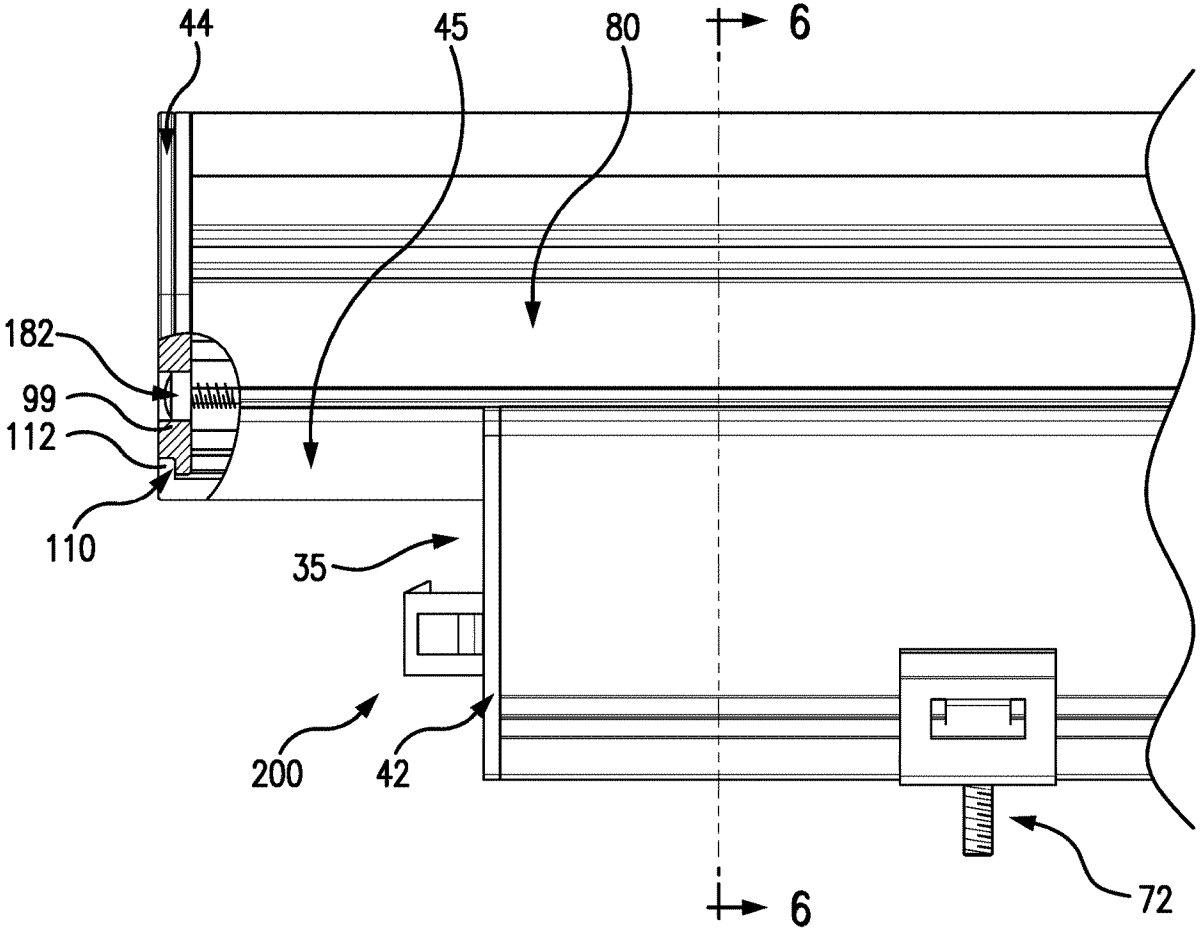
FIG. 4A is an enlarged partially cutaway view of an end portion of the fixture.

FIG. 3 further shows the carrier assembly as including a pair of endplates 99, 100 (e.g., stamped aluminum) secured to ends of the carrier main body such as via screws 101. For this fastening, the carrier main body extrusion may include channels 102 for receiving the screws 101. FIG. 4A shows the endplates 99, 100 (FIG. 2) as having an annular rebate 110 receiving an inner diameter (ID) portion 112 of the pivot ring 44 to axially retain the carrier and pivotally mount it for rotation about the axis 500.

FIG. 4A also shows a first connector 200 mounted to the endplate portion 42 of the first end 32 end member 35.

FIG. 2 shows a mounting aperture 202 for the connector 200. FIG. 2 further shows the second end 34 end member 36 as having an aperture 210 for passing a cable 212 having a distal end connector 214. In the exemplary implementation, the connector 214 is connected to a power and/or other control source. Multiple such fixtures may be connected end-to-end by connecting the connector 214 of each subsequent fixture to the connector 200 of a prior fixture. FIG. 2 also shows apertures 220 along the base main body outer wall 68. In the exemplary embodiment, these apertures pass wiring (not shown) from the driver in the base to the circuit board assembly in the light carrier. The aforementioned US 62/234,949 application shows an alternate routing wherein the wiring passes from the driver back out through the endplate portion 42 and collar segment 45.

To pass the wiring into the carrier, a portion of the carrier main body may be cut away (e.g., one or more circumferentially extending slot(s) (not shown) aligned to overlap the aperture(s) 220 to accommodate rotation).

FIG. 3 further shows the carrier assembly as comprising a transparent or translucent cover 120 (e.g., a molded or extruded plastic). The cover 120 extends between a first end and a second end generally coextensive with the carrier main body to cooperate with the carrier main body to essentially form a full circumferential enclosure. FIG. 6 shows the cover and carrier body formed with complementary mating features such as longitudinal beads 122 at circumferential edges of the cover interfitting with longitudinal channels 124 at circumferential ends of the carrier main body. FIG. 3 further shows the carrier assembly as including an optic 130 which may also be a molded or extruded plastic (e.g., PMMA). As with the cover, the exemplary optic extends between a first end and a second end generally coplanar with ends of the carrier main body. The exemplary optic includes a central portion 132 for distributing light and a pair of lateral mounting wings or flanges 134. The exemplary mounting wings interfit with mounting features of the carrier main body (e.g., channels 136, FIG. 6). The exemplary central portion 132 is convex-convex.

An exemplary optic is essentially longitudinally coextensive with the carrier (e.g., slightly shorter due to mounting considerations). There may be a single-piece optic per fixture or may be multiple end-to-end optic pieces. End-to-end optics may be particularly relevant when molded rather than extruded optics are involved. This would allow multiples of one standard optic length to be used for a corresponding series of fixture and carrier lengths. Exemplary fixture and carrier lengths are 0.2 m or greater (e.g., 0.5 m to 3.0 m). Exemplary optics similarly are 0.2 m or greater. For shorter optics assembled end-to-end in a given carrier, exemplary lengths are 0.2 m to 0.5 m.

In the exemplary optic, the wings 134 resemble gull wings allowing a convex upper surface 133 of the optic central portion 132 to extend to form inboard sidewalls of channels 135 separating root portions of the wings from the central portion. This allows a greater angular extent of the surface 133 to pass more light. As noted above, an underside surface 137 of the central portion 132 is also convex in the exemplary embodiment.

FIG. 3 further shows an exemplary light source in the form of light emitting diodes (LED) 140 mounted on circuit boards 142. In an exemplary implementation, there is an end-to-end assembly of circuit boards electrically interconnected via connectors 144 and leads 146. The board assembly is mounted to a board carrier 150. In the exemplary implementation, the board carrier 150 has an outboard surface 152 forming a channel receiving the board assembly with sidewalls of the channel engaging edges of the board assembly. The exemplary board carrier 150 further includes an underside 154.

Figure 12:
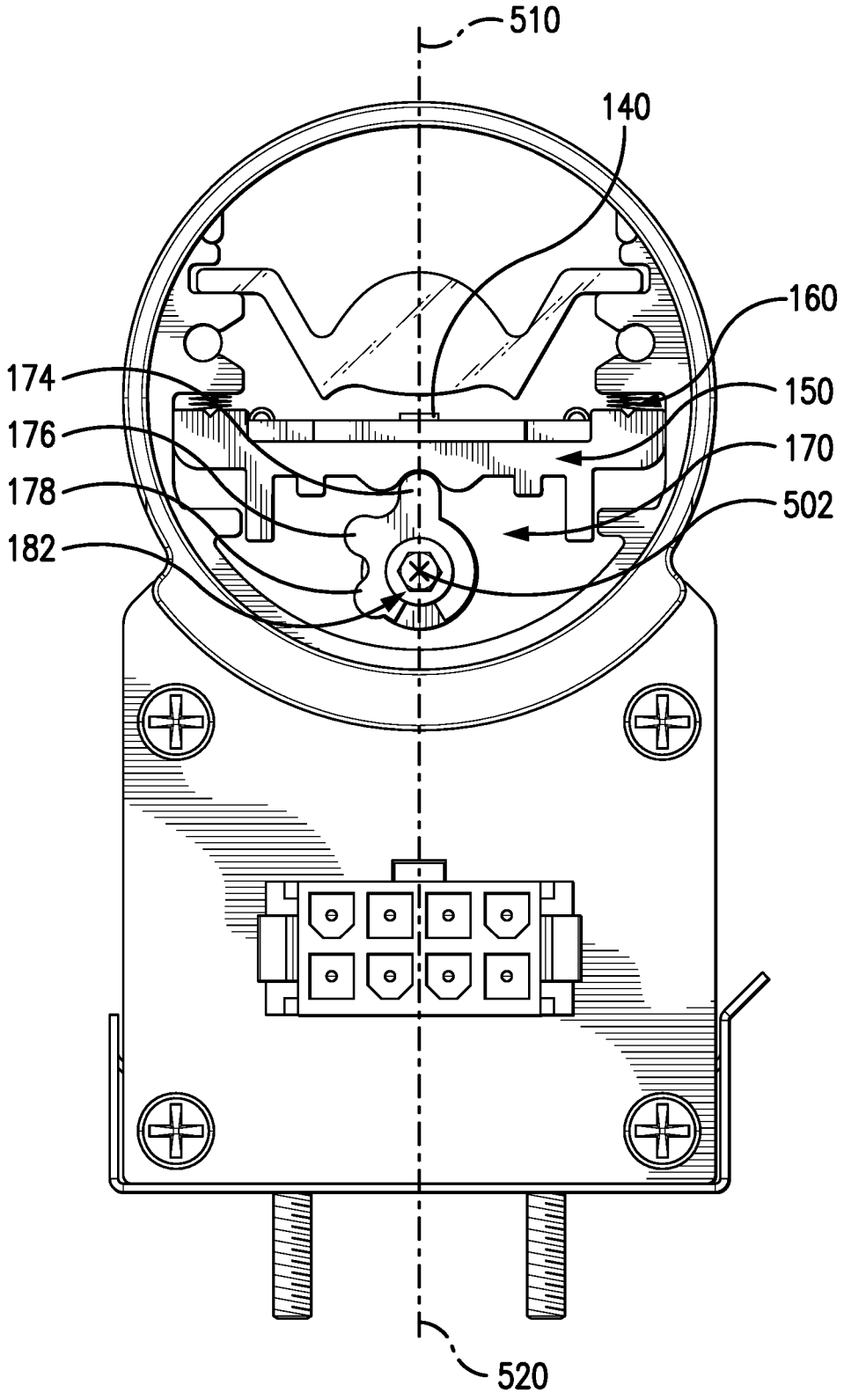
FIG. 12 is an end view of the fixture with an end cap removed in a first condition of adjustment.
Figure 13:
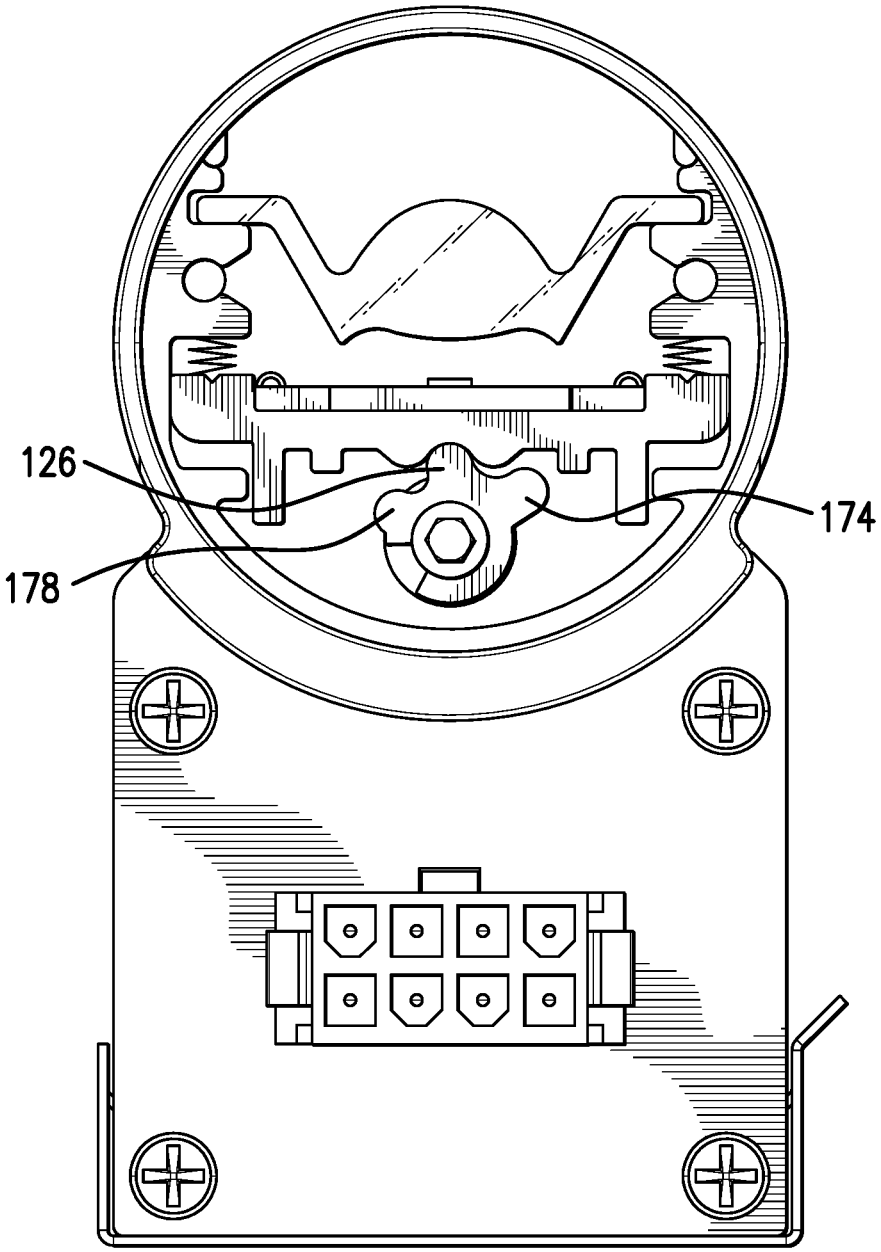
FIG. 13 is a view of the fixture in a second condition of adjustment.
Figure 14:
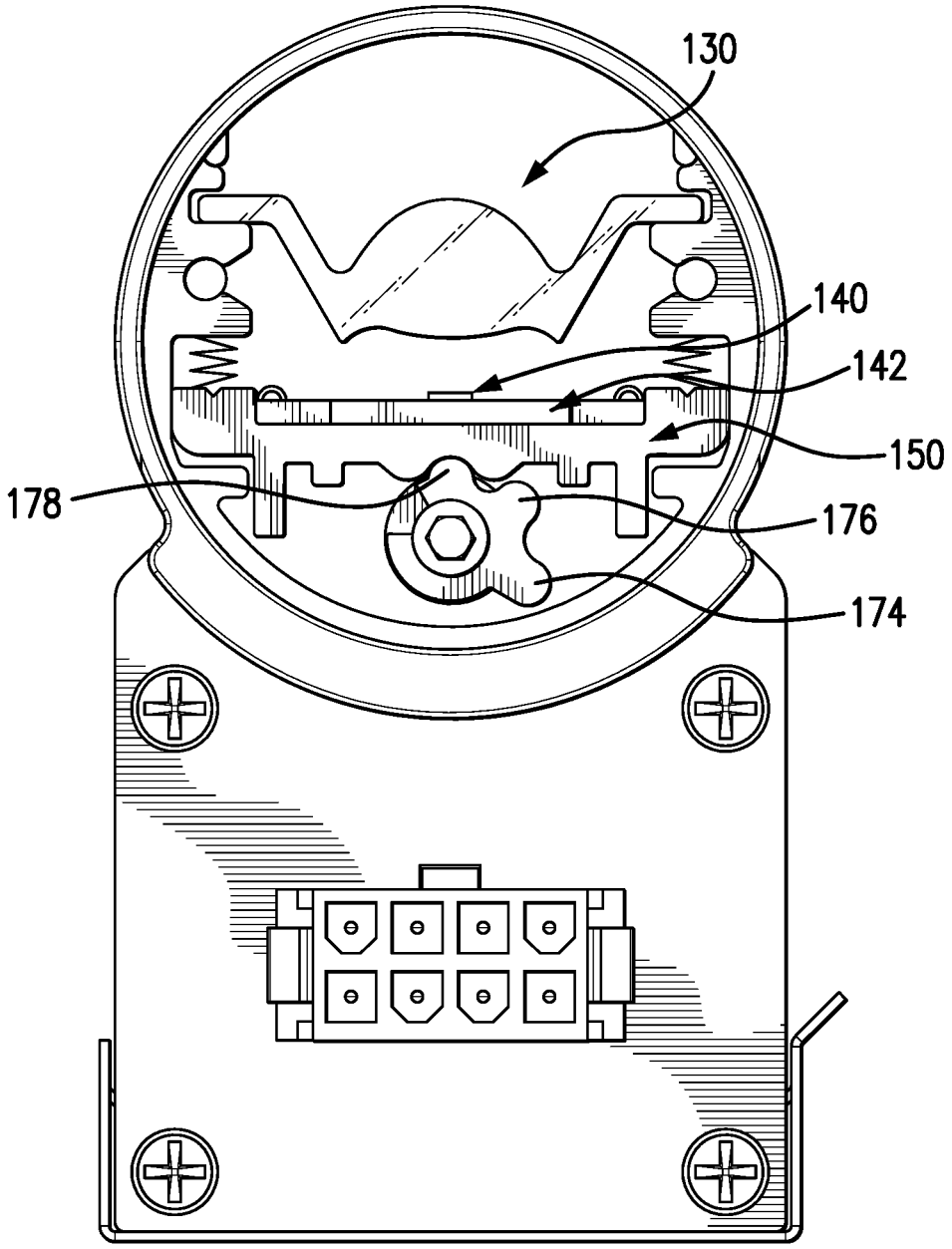
FIG. 14 is a view of the fixture in a third condition of adjustment.

As is discussed further below, the board carrier 150 may be shifted toward and away from the optic 130 to provide light distribution adjustment (e.g., a zoom effect) by adjusting the effective beam angle. FIG. 12 shows a position of the board carrier 150 and LED 140 relatively close to the optic. FIG. 13 shows an intermediate position and FIG. 14 shows a position relatively withdrawn away from the optic. The exemplary FIG. 12 condition is associated with a relatively broad beam (e.g., a 45° angle). This beam definition may be associated with the beam angle boundaries at 50% of maximum intensity (at center of beam) for a symmetric beam. The exemplary optic and light distribution is symmetric across the longitudinal centerplane 510 of the optic and carrier. In a neutral carrier orientation, this centerplane is coincident with a longitudinal centerplane 520 of the mounting base 26. The exemplary FIG. 13 condition narrows the beam to approximately 30°. The exemplary FIG. 14 condition narrows the beam to approximately 15°. Alternative optics and distributions may be asymmetric to provide a desired evenness or unevenness of the light across the area illuminated.

In the exemplary embodiment, springs (e.g., metallic coil springs) 160 bias the board carrier 150 in one direction (e.g., toward the withdrawn condition in the illustrated example). Alternatively, wave springs may be used (e.g. metallic wave springs as are shown in Application No. 62/234,949). An adjuster may be provided for shifting the board carrier 150 and thus the LED 140 against the bias of the springs. The exemplary adjuster 170 (FIG. 12) has effectively a stepwise cam pivotally mounted for rotation about an axis 502. The exemplary axis 502 is parallel to and spaced apart from the axis 500. The exemplary cam is formed as an extrusion (e.g., aluminum alloy) 172 having a plurality of lobes or ribs 174, 176, 178. The exemplary extrusion has a hollow central channel 180 (FIG. 6) which, at one or both end portions, receives the shaft(s) of screw(s) 182 (FIG. 3) which, in turn, extend through associated holes 184 in the endplates (FIG. 3).

In the exemplary illustrated embodiment, only one of the ends of the adjuster 170 receives a screw 182. The opposite end has a protruding boss portion 190 (FIG. 3) axially protruding beyond the lobes and having a circular exterior surface portion. This circular exterior surface portion rides in a circular rebate (e.g., bore) 192 (FIG. 6) in the axially inboard/inward face of the second end endplate 100. In an exemplary method of manufacture, the cam extrusion is extruded from aluminum and then the boss 190 is machined. The exemplary cam main body has an open slot extending inward from a periphery to the central channel 180. This is an artifact of eased manufacture by extrusion to form the channel 180 instead of a more material-intensive and labor-intensive process of drilling a short bore to receive the adjusting screw(s) 182.

With the screw(s) 182 securely tightened into the extrusion 172, rotation of the screw(s) (e.g., with the screwdriver) rotates the extrusion about its axis and allows each of the lobes 174, 176, 178 to alternatively be brought into engagement with the underside 154. Radial ends of each of the lobes have progressively different positions relative to the axis 502 to provide a stepwise camming effect providing a discretely adjustable spacing (e.g., as distinguished from a continuously adjustable spacing associated with a smooth arcuate cam). The exemplary underside 154 of the board carrier 150 includes a recess 156 for receiving the ends of one of the lobes to provide a detented engagement between the extrusion and the board carrier 150.

The fixture may be made using otherwise conventional or yet-developed materials and techniques.

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

One or more embodiments have been described. Nevertheless, it will be understood that various modifications may be made. For example, when applied to an existing basic system, details of such configuration or its associated use may influence details of particular implementations. Accordingly, other embodiments are within the scope of the following claims.

What is claimed is:

1. A light fixture comprising:

a base;

a light carrier pivotally mounted to the base;

a light source carried by the light carrier; and an optic carried by the light carrier;

wherein:

the light source is mounted for adjustable spacing between the light source and the optic;

the light source comprises:

a circuit board carrying light emitting diodes; and a board carrier carrying the circuit board;

one or more springs bias the light source in a first direction relative to the optic; and an adjuster for shifting the light source against the bias to provide the adjustable spacing comprises a cam mounted for rotation about a cam axis and engageable with the board carrier via rotation about the cam axis to shift the light source against the bias to provide the adjustable spacing.

2. The light fixture of claim 1 wherein:

the one or more springs comprise one or more coil springs along each side of the optic.

3. The light fixture of claim 1 wherein the cam has a detented engagement with the board carrier.

4. The light fixture of claim 3 wherein the cam has a plurality of discrete surface portions providing the adjustable spacing as a discretely adjustable spacing.

5. The light fixture of claim 3 wherein the cam comprises a metallic extrusion having a plurality of lobes.

6. The light fixture of claim 3 wherein a screw is threaded into the cam and passes through an endplate of a housing of the light carrier.

7. The light fixture of claim 6 wherein the screw is drivable to rotate the cam about the cam axis.

8. The light fixture of claim 1 wherein the light source comprises a plurality of said circuit boards carried by a single said board carrier; and on each said circuit board, the light emitting diodes are in a linear array.

9. The light fixture of claim 1 wherein:

the light carrier is mounted to the base for rotation about a light carrier axis.

10. The light fixture of claim 9 further comprising:

a detent mechanism detenting the rotation about the light carrier axis and comprising extruded scallop features in a housing of the light carrier interacting with a detenting member.

11. The light fixture of claim 10 wherein:

the detenting member is self-sprung and formed as a molding or an extrusion.

12. The light fixture of claim 1 further comprising:

a driver carried within the base.

13. The light fixture of claim 1 wherein:

the optic comprises a molded or extruded member having a central portion for passing light from the light source and a pair of lateral mounting flanges.

14. A method for using the system of claim 1, the method comprising:

rotating the cam mounted about the cam axis shift the light source against the bias to adjust the adjustable spacing.

15. The method of claim 14 wherein:

the rotating includes a detented cooperation of the cam and a carrier of the light source.

16. The method of claim 14 further comprising:

a detented rotating of the light carrier relative to the base.

17. A light fixture comprising:

a base;

a light carrier;

a light source carried by the light carrier; and an optic carried by the light carrier, wherein:

the light source is mounted for adjustable spacing between the light source and the optic; and the light carrier is mounted to the base for the rotation about a light carrier axis by a pair of rings protruding from a main portion of the base and capturing a housing of the light carrier.

18. The light fixture of claim 17 further comprising:

a detent mechanism detenting the rotation about the light carrier axis and comprising extruded scallop features in the housing of the light carrier interacting with a detenting member.

19. The light fixture of claim 18 wherein:

the detenting member is self-sprung and formed as a molding or an extrusion.

20. The light fixture of claim 17 further comprising:

a driver carried within the base.

21. The light fixture of claim 17 wherein the rings engage opposite axial ends of the light carrier.

22. The light fixture of claim 17 wherein the light carrier is accommodated in a concavity of the base.

* * * * *